US008714732B2

(12) United States Patent
Ikagawa et al.

(10) Patent No.: US 8,714,732 B2
(45) Date of Patent: May 6, 2014

(54) LIQUID EJECTING APPARATUS

(75) Inventors: Takamasa Ikagawa, Shiojiri (JP); Katsumi Okamoto, Azumino (JP); Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 13/084,033

(22) Filed: Apr. 11, 2011

(65) Prior Publication Data

US 2011/0254893 A1 Oct. 20, 2011

(30) Foreign Application Priority Data

Apr. 16, 2010 (JP) ..... 2010-095024

(51) Int. Cl.
*B41J 2/01* (2006.01)

(52) U.S. Cl.
USPC ..... 347/104; 347/16; 347/101

(58) Field of Classification Search
USPC ..... 347/16, 101, 104
See application file for complete search history.

(56) References Cited

U.S. PATENT DOCUMENTS

| | | | | |
|---|---|---|---|---|
| 7,527,349 | B2 | 5/2009 | Jung et al. | |
| 7,543,898 | B2 | 6/2009 | Matsuhashi | |
| 2007/0146401 | A1* | 6/2007 | Ishikawa et al. | 347/9 |
| 2008/0218577 | A1 | 9/2008 | Suzuki | |

FOREIGN PATENT DOCUMENTS

| | | |
|---|---|---|
| CN | 101138905 | 3/2008 |
| CN | 101332715 | 12/2008 |
| JP | 2007-050704 A | 3/2007 |

* cited by examiner

*Primary Examiner* — Justin Seo
(74) *Attorney, Agent, or Firm* — Workman Nydegger

(57) ABSTRACT

The invention provides a liquid ejecting apparatus which can prevent a target having liquid ejected thereon from warping irrespective of the type of the target. An ink jet printer includes a recording head configured to eject ink from a nozzle formed on a nozzle-formed surface onto a recording sheet being transported from an upstream side to a downstream side, and a plurality of supporting belts arranged so as to oppose the nozzle-formed surface and each having a supporting portion extending along the direction of transport of the recording sheet. The respective supporting belts are arranged so as to be capable of moving along the width direction intersecting the direction of transport of the recording sheet.

1 Claim, 3 Drawing Sheets

LIQUID EJECTING APPARATUS

CROSS REFERENCE TO RELATED APPLICATIONS

This application claims the benefit of Japanese Application No. 2010-095024 filed on Apr. 16, 2010, which application is incorporated by reference in its entirety.

BACKGROUND

1. Technical Field

The present invention relates to a liquid ejecting apparatus such as an ink jet printer.

2. Related Art

In general, an ink jet printer is widely known as a liquid ejecting apparatus configured to eject liquid from a liquid ejection head. Such a printer includes so-called a line head printer configured to perform printing by ejecting ink (liquid) from a recording head (liquid ejection head) fixedly arranged with respect to a recording sheet (target) during transport. In general, in such a printer, when the ink is ejected onto a recording sheet, a printing surface of the recording sheet is swelled with the ink, and hence the entire recording sheet is warped (curled).

The warping of the recording sheet as described above may cause a transport failure of the recording sheet. However, it is known in the related art that such a transport failure is alleviated by intensively creating cockling (waving phenomenon) on the recording sheet at the time of printing. In other words, when a plurality of ribs are provided on a platen that supports the transported recording sheet at the time of printing so as to extend in the direction of transport of the recording sheet in parallel to each other in the direction of width of the recording sheet at certain intervals, portions of the recording sheet corresponding to portions between the ribs sag and hence the cockling is created on the recording sheet at the time of printing.

As an example of the printer having the plurality of ribs formed on the platen as described above, a printer as disclosed in JP-A-2007-50704 is known in the related art.

However, since the printer disclosed in JP-A-2007-50704 has a configuration in which the plurality of ribs are fixed on the platen, the intervals between the ribs cannot be changed. Therefore, there is an problem such that when the size or the thickness of the recording sheet is changed, the intended cockling cannot be created on the recording sheet, and hence the warping (curling) of the recording sheet cannot be restrained.

SUMMARY

An advantage of some aspects of the invention is that a liquid ejecting apparatus which can restrain a target having liquid ejected thereon from warping irrespective of the type of the target.

In accordance with an embodiment of the invention, there is provided a liquid ejecting apparatus configured to eject liquid to a target being transported including: a liquid ejection head configured to eject liquid from a nozzle formed on a nozzle-formed surface to the target; a plurality of supporting members arranged so as to oppose the nozzle-formed surface and each having a supporting portion extending along the direction of transport of the target; and a moving unit configured to cause the supporting members to move along the direction of width of the target, which intersects the direction of transport.

In this configuration, the intended cockling can be created on the target when the liquid is ejected by changing the distances between the respective supporting belts according to the type of the target on which the liquid is ejected. Therefore, the target can be provided with elasticity, and hence the target is prevented from warping after the liquid is ejected thereto. Therefore, the target having the liquid ejected thereon can be prevented from warping irrespective of the type of the target.

Also, the distances between the respective supporting members can be changed by the moving unit easily.

In accordance with the embodiment of the invention, the respective supporting members are endless belts which are capable of making circulatory movements about an axial line extending in the width direction.

In this configuration, for example, even when portions of the respective belts which support the target are stained with liquid, the target can be supported by portions of the respective belts which are not stained with the liquid by causing the respective belts to make circulatory movements to avoid the target from being supported by the stained portion, so that the target can be avoided from being stained with the liquid.

In accordance with the embodiment of the invention, a liquid receiving portion configured to receive the liquid ejected from the nozzle in a state in which the target is not supported by the respective supporting portions is arranged at a position opposing the nozzle-formed surface with the intermediary of the supporting portions of the respective supporting members.

In this configuration, for example, when the flushing for forcedly discharging (draining) the liquid from the nozzle is performed in a state in which the target is not supported by the respective supporting portions of the respective supporting members for the purpose of resolving clogging of the nozzle or the like, the discharged liquid can be received by the liquid receiving portion, so that the interior of the apparatus can be prevented from being stained with the liquid.

In accordance with the embodiment of the invention, a feeding unit configured to feed the target transported from the upstream side onto the supporting portions of the respective supporting members, and a discharging unit configured to discharge the target having the liquid ejected thereon on the respective supporting portions from over the respective supporting portions to a downstream side, and the distance between the feeding unit and the discharging unit is narrower than the distance between the precedingly transported target and the trailing target.

In this configuration, even when the targets are transported continuously, timings when the target is not present between the feeding unit and the discharging unit can be made, and hence the flushing can be performed between the continuously transported targets.

The liquid ejecting apparatus according to the embodiment of the invention includes a cleaning unit configured to perform cleaning of the respective supporting members.

In this configuration, the respective supporting members stained with the liquid when the flushing is performed can be cleaned by cleaning with the cleaning unit.

BRIEF DESCRIPTION OF THE DRAWINGS

The invention will be described with reference to the accompanying drawings wherein like numbers reference like elements.

DESCRIPTION OF THE EXEMPLARY EMBODIMENTS

Figure 1:
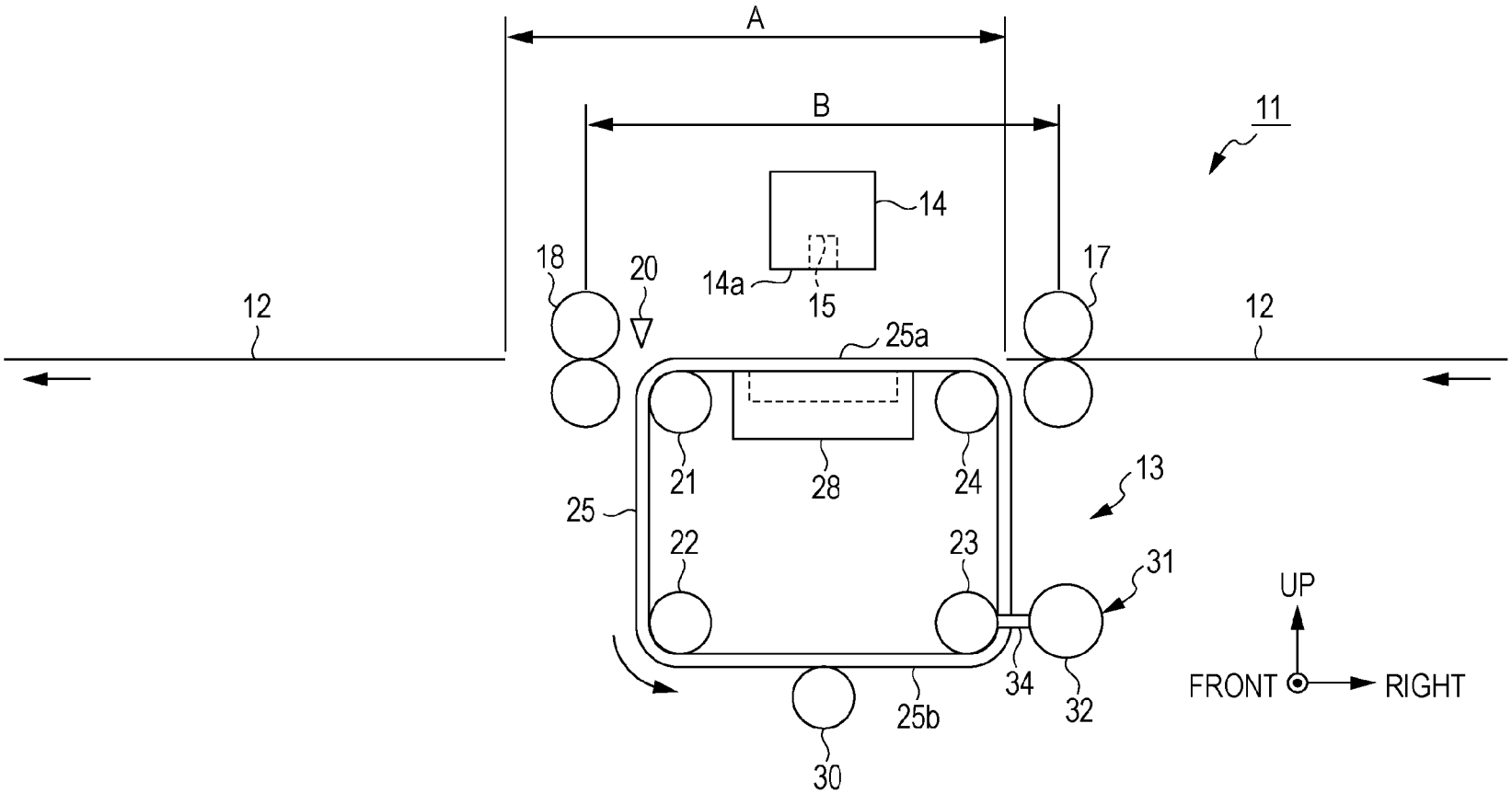
FIG. 1 is a schematic drawing showing a substantial configuration of an ink jet printer according to an embodiment.

Referring now to the drawings, an embodiment of a liquid ejecting apparatus according to an aspect of the invention implemented in an ink jet printer will be described. In the following description, "fore-and-aft direction", "vertical direction", and "lateral direction" indicate "front and back directions", "up and down directions", and "left and right directions" indicated by arrows in FIG. 1 unless otherwise specified.

As shown in FIG. 1, an ink jet printer 11 as a liquid ejecting apparatus is so-called a line head printer, which includes a supporting unit 13 configured to support a recording sheet 12 as a target to be transported from the right side, which is an upstream side, toward the left side, which is a downstream side, along a transporting route at a constant speed. A recording head 14 as a liquid ejection head configured to eject ink as liquid to the recording sheet 12 supported by the supporting unit 13 is arranged above the supporting unit 13 in a fixed state so as to oppose the supporting unit 13.

The recording head 14 extends in the fore-and-aft direction (width direction) orthogonal to the direction of transport of the recording sheet 12 in the horizontal direction, and the length in the fore-and-aft direction (longitudinal direction) is set to be slightly longer than the width of the recording sheet 12 in the fore-and-aft direction. Ink is supplied from an ink cartridge (not shown) to the recording head 14, and a lower surface of the recording head 14 is a horizontal nozzle formed surface 14*a* having a plurality of nozzles 15 opened therethrough. Then, the respective nozzles 15 are arranged on the nozzle formed surface 14*a* along the fore-and-aft direction in which the recording head 14 extends.

A piezoelectric element 16 (see FIG. 4) configured to cause ejection of ink from the respective nozzles 15 is provided in the recording head 14. Then, by the drive of the piezoelectric element 16 (see FIG. 4), the ink in the ink cartridge (not shown) is supplied into the recording head 14, and the ink in the recording head 14 is ejected from the respective nozzles 15 toward the recording sheet 12 supported by the supporting unit 13, thereby achieving printing.

A feed roller pair 17 as a feeding unit including a pair of upper and lower rollers configured to feed a plurality of recording sheets 12 transported continuously from an upstream side at a predetermined transport interval A in sequence onto the supporting unit 13 in a state of being pinched are arranged on a right side of the supporting unit 13. In contrast, a discharging roller pair 18 as a discharging unit including a pair of upper and lower rollers configured to discharge the respective recording sheets 12 on which the ink is ejected in sequence on the supporting unit 13 from over the supporting unit 13 to a downstream side in a state of being pinched are arranged on the left side of the supporting unit 13.

The respective roller pairs 17 and 18 are configured to be rotated respectively by a transporting motor 19 (see FIG. 4) about an axial line extending in the fore-and-aft direction, which is a width direction orthogonal to the direction of transport of the recording sheet 12. A distance B between the centers of the respective roller pairs 17 and 18 is smaller than the transport interval A of the recording sheets 12. A sheet end sensor 20 configured to detect an end of the recording sheet 12 discharged by the discharging roller pair 18 in the direction of transport is arranged at a position above a left end portion of the supporting unit 13 adjacent to the discharging roller pair 18 on the right side.

Figure 2:
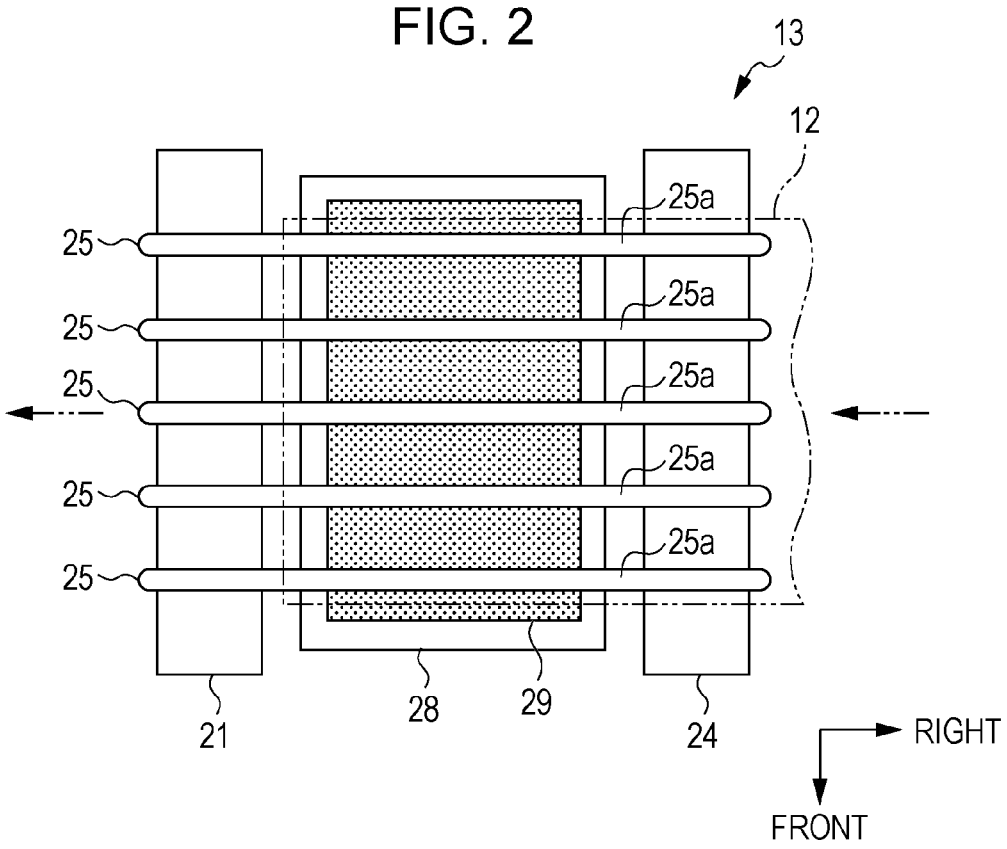
FIG. 2 is a plan view showing a positional relationship between respective supporting belts and a flushing box in the same printer.

As shown in FIG. 1 and FIG. 2, the supporting unit 13 includes four rollers 21 to 24 configured to rotate about axial lines extending in the fore-and-aft direction and arranged at a distance from each other in two rows and two columns when viewed in the fore-and-aft direction, and a plurality of (five in this embodiment) endless supporting belts 25 entrained about the respective rollers 21 to 24 as supporting members. Therefore, the respective supporting belts 25 are formed into substantially a rectangular shape when viewed from the fore-and-aft direction, and configured to function as platens.

The respective rollers 21 to 24 are; the first roller 21 arranged on the upper left side, the second roller 22 arranged on the lower left side, the third roller 23 arranged on the lower right side, and the fourth roller 24 arranged on the upper right side when viewed from the front. The first roller 21 is configured to be rotated counterclockwise when viewed from the front by a rotating motor 26 (see FIG. 4) such as a stepping motor.

Then, when the first roller 21 is rotated by the rotating motor 26 (see FIG. 4), the respective supporting belts 25 go around the respective rollers 21 to 24 counterclockwise in association with the rotation of the first roller 21 when viewed from the front, and the respective rollers 22 to 24 are rotated (driven) in association with the go-around movement of the respective supporting belts 25 when viewed from the front. The first roller 21 is provided with a first rotary encoder 27 (see FIG. 4) configured to detect the amount of rotation of the first roller 21.

The respective supporting belts 25 are formed of elastomer such as rubber, and the cross-sectional shape of each of the supporting belt 25 is a substantially circular shape. The supporting belts 25 are arranged in parallel to each other equidistantly along the fore-and-aft direction, and are movable independently along the fore-and-aft direction. Positioning of each of the respective supporting belts 25 in the fore-and-aft direction is achieved by urging the respective rollers 21 to 24 inward from the outside by its elasticity.

Portions of the respective supporting belts 25 positioned above the first and fourth rollers 21 and 24 constitute a transporting route of the recording sheet 12, and corresponds to supporting portions 25*a* that support the recording sheet 12. Therefore, the respective supporting portions 25*a* extend along the lateral direction, which correspond to the direction of transport of the recording sheet 12. Portions of the respective supporting belts 25 other than the supporting portions 25*a* are non-supporting portions 25*b*.

A flushing box 28 as a liquid receiving portion that receives ink forcedly discharged from the respective nozzles 15 in a state in which the recording sheet 12 is not supported by the respective supporting portions 25*a* is arranged at a position on the opposite side from the nozzle formed surface 14*a* of the recording head 14 with respect to the supporting portions 25*a* of the respective supporting belts 25. In other words, the flushing box 28 is a member which receives ink discharged when flushing operation for forcedly discharging (draining) the ink from the nozzles 15 irrespective of printing is performed for the purpose of resolving clogging of the nozzles 15 or the like.

The flushing box 28 is formed into a bottomed square box shape opening on top, and accommodates an ink absorbing material 29 configured to absorb and keep ink received when the flushing is performed in the interior thereof.

A sponge roller 30 as a cleaning unit rotatable about an axial line extending in the fore-and-aft direction is arranged between the second roller 22 and the third roller 23 located at the non-supporting portions 25*b* of the supporting belts 25 so as to come into abutment with the non-supporting portions 25*b* of the respective supporting belts 25 from below. In other words, the sponge roller 30 is configured to wipe off ink or the like adhered to the respective supporting belts 25 by being rotated in association with circulatory movements of the respective supporting belts 25.

Figure 3:
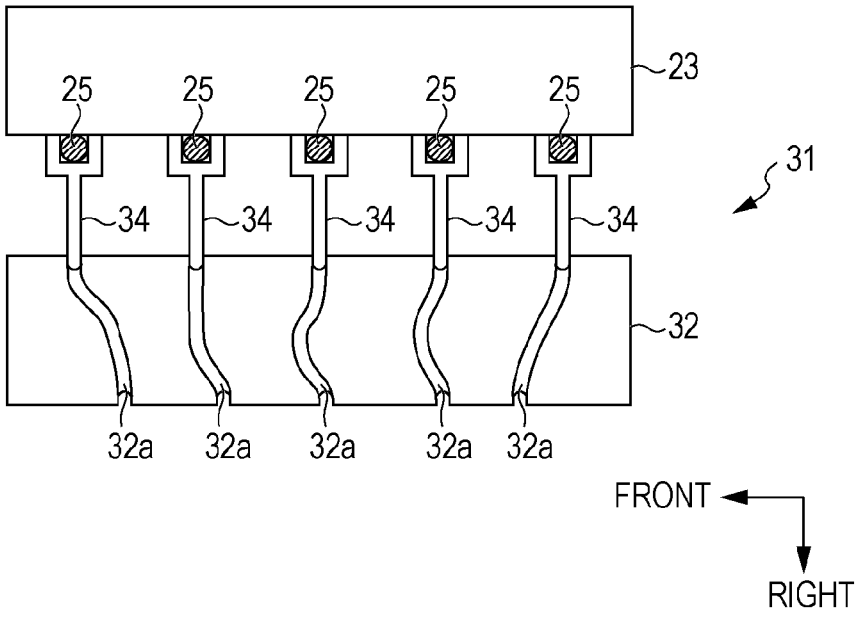
FIG. 3 is a cross-sectional plan view showing a moving device of the same printer.

As shown in FIGS. 1 and 3, a moving device 31 as a moving unit for moving the respective supporting belts 25 in the fore-and-aft direction is arranged on the right side of the third roller 23. As shown in FIG. 3, the moving device 31 includes a cylindrical cam 32 configured to be rotatable about an axial line extending in the fore-and-aft direction, and a cam motor 33 configured to cause the cylindrical cam 32 to rotate (see FIG. 4). In addition, the moving device 31 includes a plurality of (five in this embodiment) adjusting members 34 configured to slidably pinch the respective supporting belts 25 at left end portions thereof and to be slidably inserted respectively into a plurality of (five in this embodiment) cam grooves 32*a* formed on the surface of the cylindrical cam 32 at right end portions thereof.

The respective adjusting members 34 move in the fore-and-aft direction in association with the rotation of the cylindrical cam 32 so that the intervals of the respective supporting belts 25 in the fore-and-aft direction are adjusted. In other words, the intervals of the respective supporting belts 25 in the fore-and-aft direction are adjusted by adjusting the angle of rotation of the cylindrical cam 32 according to the types (size, thickness, material, etc.) of the recording sheet 12 to be subject to printing so that cockling which minimizes the warping at the time of printing is created on the recording sheet 12. The cylindrical cam 32 is provided with a second rotary encoder 35 (see FIG. 4) configured to detect the amount of rotation (angle of rotation) of the cylindrical cam 32.

Figure 4:
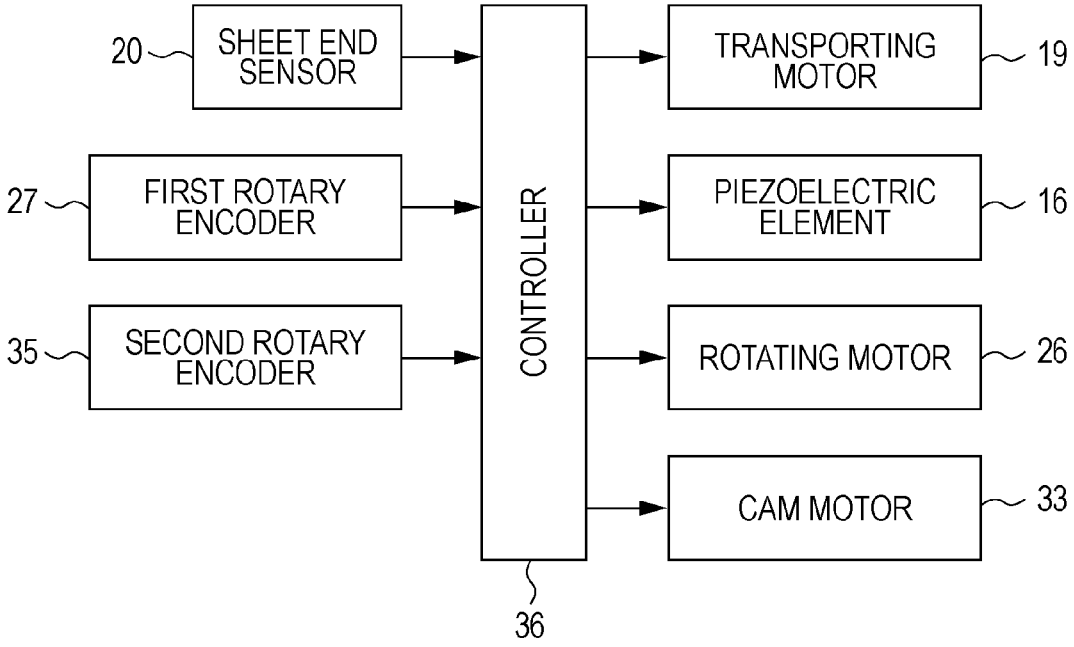
FIG. 4 is a block diagram showing an electrical configuration of the same printer.

As shown in FIG. 4, the ink jet printer 11 (see FIG. 1) includes a controller 36 configured to perform centralized control of the entire apparatus. The sheet end sensor 20, the first rotary encoder 27, and the second rotary encoder 35 are electrically connected to an input-side interface (not shown) of the chamber 36, respectively. In contrast, the transporting motor 19, the piezoelectric element 16, the rotating motor 26, and the cam motor 33 are electrically connected to an output-side interface (not shown) of the controller 36, respectively.

The controller 36 is configured to control driving of the transporting motor 19, the piezoelectric element 16, the rotating motor 26, and the cam motor 33 individually on the basis of signals or the like sent from the sheet end sensor 20, the first rotary encoder 27, and the second rotary encoder 35.

Subsequently, an operation of the ink jet printer 11 will be described.

When performing printing on the recording sheet 12, first of all, the rotating motor 26 is rotated, thereby rotating the first roller 21. Then, the respective supporting belts 25 make circulatory movements around the respective rollers 21 to 24 counterclockwise when viewed from the front. Subsequently, the intervals of the respective supporting belts 25 in the fore-and-aft direction are adjusted by controlling the driving of the cam motor 33 and adjusting the angle of rotation of the cylindrical cam 32 according to the type of the recording sheet 12 to be subject to printing so that the cockling which minimizes the warping at the time of printing is formed on the recording sheet 12.

Subsequently, the rotating motor 26 is stopped and the transporting motor 19 is driven so as to cause the respective roller pairs 17 and 18 to rotate. Then, the feed roller pair 17 feeds the recording sheets 12 continuously in sequence at a constant speed at the predetermined transport interval A onto the respective supporting portions 25*a* of the stopped respective supporting belts 25. When the recording sheet 12 fed onto the respective supporting portions 25*a* passes right below the recording head 14, the piezoelectric element 16 is driven, and ink is ejected from the respective nozzles 15 of the recording head 14 onto the recording sheet 12, thereby performing printing.

At this time, since the recording sheet 12 is subject to ejection of the ink while being supported by the respective supporting portions 25*a* adjusted in intervals in the fore-and-aft direction, the recording sheet 12 is formed with the cockling (wavy state) which minimizes warping thereof at the time of printing. In other words, the recording sheet 12 is formed with the cockling having crests at portions supported by the respective supporting portions 25*a*, and troughs at portions not supported by the respective supporting portions 25*a*. Accordingly, the recording sheet 12 is provided with elasticity, and hence the warping of the recording sheet 12 after the printing is effectively prevented.

The recording sheet 12 after having been subject to the printing on the respective supporting portions 25*a* is transported from over the respective supporting portions 25*a* toward the downstream side by the discharging roller pair 18. In this manner, the respective recording sheets 12 are subject to printing in sequence.

During printing of the respective recording sheets 12, flushing is performed. The flushing is an operation which causes ink to be forcedly discharged (drained) from all the nozzles 15 periodically in order to prevent some of the nozzles 15 on the recording head 14, which do not eject ink in the printing pattern of this time, from being clogged with ink increased in viscosity. Then, the flushing as described above is performed at timing when a trailing end of a precedingly transported recording sheet 12 transported on the respective supporting portions 25*a* of the respective supporting belts 25 is detected by the sheet end sensor 20.

The reason is as follows. Since the distance B between centers between the centers of the respective roller pairs 17 and 18 is smaller than the transport interval A of the recording sheets 12, the trailing recording sheet 12 is not yet fed onto the respective supporting portions 25*a* at a timing when the trailing end of the precedingly transported recording sheet 12 is detected by the sheet end sensor 20. By performing the flushing at this timing, the flushing ink (drained ink) discharged forcedly from all the nozzles 15 of the recording head 14 is received by the flushing box 28, and is absorbed and held by the ink absorbing material 29 stored in the flushing box 28.

At this time, part of the flushing ink adheres to portions of the respective supporting portions 25*a* of the respective supporting belts 25 corresponding to the respective nozzles 15, and hence the corresponding portions are stained with the flushing ink. Therefore, the rotating motor 26 is rotated immediately after the flushing and causes the respective supporting belts 25 to make circulatory movements until the portions of the respective supporting portions 25*a* of the respective supporting belts 25 stained with the flushing ink are moved to a portion between the first roller 21 and the second roller 22, and then causes the supporting belts 25 to stop.

The action from the start of the flushing until the portions of the respective supporting portions 25*a* of the supporting belts 25 stained with the flushing ink are moved (retracted) to the portion between the first roller 21 and the second roller 22 is completed before the trailing recording sheet 12 is fed onto the respective supporting portions 25*a*. Therefore, when the trailing recording sheet 12 is fed onto the respective supporting portions 25*a*, the respective supporting portions 25*a* are not stained with the flushing ink, and the respective supporting belts 25 are not moving. In other words, the recording sheet 12 is prevented from being stained with the flushing ink and lowering of the printing accuracy of the recording sheet 12 is also avoided.

In this manner, the flushing is performed periodically between the precedingly transported recording sheet 12 and the trailing recording sheet 12, and the respective supporting belts 25 make circulatory movements by a predetermined distance so that the portions of the respective supporting belts 25 stained with the flushing ink are retracted from the respective supporting portions 25*a* during the printing. Then, the portions of the supporting belts 25 stained with the flushing ink are wiped off with the sponge roller 30 while moving in contact with the sponge roller 30.

According to the embodiment described in detail above, the following effects are achieved.

(1) Since the distances between the respective supporting belts 25 can be changed according to the type of the recording sheet 12 which is subject to printing, the intended cockling can be created on the recording sheet 12 at the time of printing. Therefore, the recording sheet 12 can be provided with elasticity, and hence the recording sheet 12 can be prevented from warping after the printing. Therefore, the recording sheet 12 can be prevented from warping after the printing irrespective of the types of the recording sheet 12.

(2) Since the respective supporting belts 25 can be moved in the fore-and-aft direction by the moving device 31, the distances between the respective supporting belts 25 can be changed easily. In addition, since the recording sheet 12 is supported by the belts, the support of the recording sheet 12 can be stabilized.

(3) Even when the respective supporting portions 25*a* of the respective supporting belts 25 are stained with the flushing ink, the respective supporting belts 25 are caused to make circulatory movements so as to avoid the trailing recording sheet 12 from being supported by the stained portions. Therefore, the recording sheet 12 is avoided from being stained with the flushing ink when the trailing recording sheet 12 is supported by the respective supporting portions 25*a* after the flushing.

(4) Since the flushing ink can be received by the flushing box 28, the interior of the ink jet printer 11 can be prevented from being stained with the flushing ink.

(5) Since the distance B between the centers of the respective roller pairs 17 and 18 is smaller than the transport interval A of the recording sheets 12, timings when the recording sheet 12 is not present between the respective roller pairs 17 and 18 (especially, on the respective supporting portions 25*a* of the respective supporting belts 25) can be created even when the respective recording sheets 12 are transported continuously. Therefore, even when the recording head 14 is fixed, the flushing can be performed between the precedingly transported recording sheet 12 and the trailing recording sheet 12.

(6) Since the portions of the respective supporting belts 25 stained with the flushing ink are wiped off with the sponge roller 30 when moving in contact with the sponge roller 30, the supporting belts 25 can be cleaned off.

(7) Since the respective supporting belts 25 are independent from each other, the supporting belts 25 can be replaced with new ones individually when they are worn or damaged.

Modifications

The embodiment described above may be modified as follows.

Figure 5:
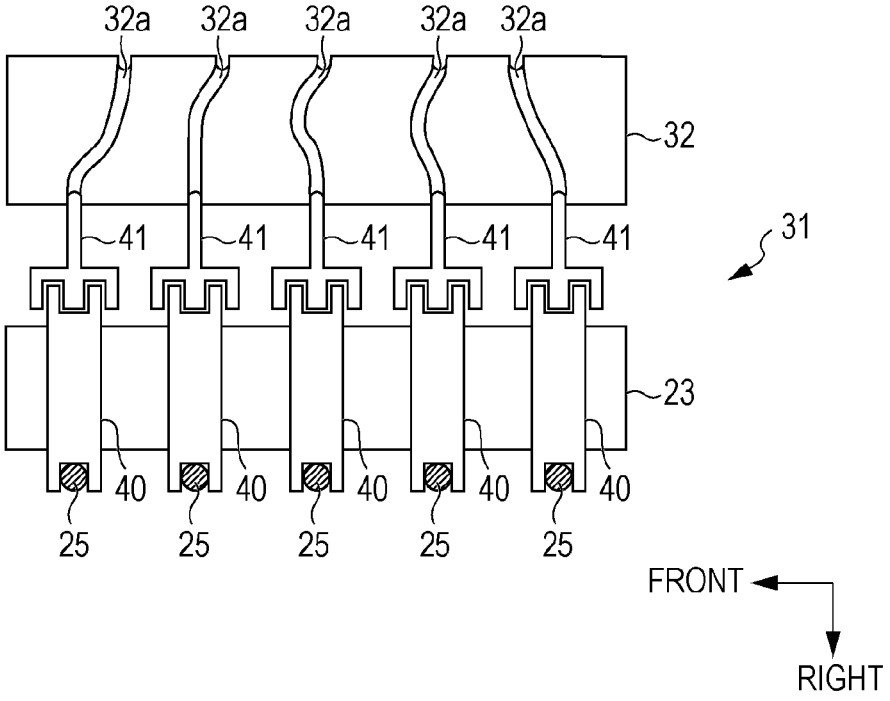
FIG. 5 is a cross-sectional plan view showing the moving device according to a modification.

As shown in FIG. 5, the moving device 31 may be positioned inside the respective supporting belts 25 and on the left side of the third roller 23, and configured to move the respective supporting belts 25 in the fore-and-aft direction via a pulley 40 provided on the third roller 23. In other words, the third roller 23 is rotatably and slidably inserted into five annular pulleys 40 and the respective supporting belts 25 are wound around grooves on the respective pulleys 40. Then, respective adjusting members 41 slidably engage the grooves on the respective pulleys 40 at right end portions thereof and are slidably inserted into the respective cam grooves 32*a* of the cylindrical cam 32 at left end portions thereof, respectively.

In this configuration, the respective adjusting members 41 move in the fore-and-aft direction in association with the rotation of the cylindrical cam 32 so that the respective supporting belts 25 can be moved smoothly in the fore-and-aft direction via the respective pulleys 40. Therefore, the intervals of the respective supporting belts 25 in the fore-and-aft direction can be adjusted easily and smoothly.

The respective supporting belts 25 may be configured with toothed belts. In this case, the respective rollers 21 to 24 are required to be formed on surfaces thereof with projections and depressions which engage the respective toothed belts. In this configuration, the respective supporting belts 25 can be prevented from slipping when the respective supporting belts 25 are caused to make circulatory movements along peripheries of the respective rollers 21 to 24.

The number of the respective supporting belts 25 as the supporting members is arbitrary as long as there are at least two of those.

A member extending linearly along the lateral direction may be employed as the supporting member instead of the respective supporting belts 25.

Grooves for the positioning of the respective supporting belts 25 in the fore-and-aft direction by engaging the respective supporting belts 25 may be provided on the surfaces of the respective rollers 21 to 24.

The distance B between the centers of the respective roller pairs 17 and 18 does not necessarily have to be smaller than the transport interval A of the recording sheets 12.

The flushing box 28 may be omitted.

The moving device 31 may also be omitted. In this configuration, manual adjustment of the intervals between the respective supporting belts 25 is required. However, the intervals between the respective supporting belts 25 can be adjusted steplessly.

The sponge roller 30 may be omitted.

The cross sections of the respective supporting belts 25 may have a tear drop shape, a polygonal shape (for example, triangle or square), or an oval shape.

In the embodiment, the liquid ejecting apparatus is applied to the ink jet printer 11. However, a liquid ejecting apparatus which ejects or discharges liquid other than ink may also be employed. The liquid ejecting apparatus in this embodiment may be applied to various liquid ejecting apparatuses including a liquid ejecting head for discharging a minute amount of liquid drop. The term "liquid drop" indicates the state of liquid discharged from the liquid ejecting apparatus, and includes those trailing in a particle state, a tear drop state, and a thready state. The term "liquid" here may be any material as long as the liquid ejecting apparatus is able to eject. For example, it may be a substance in the state of liquid phase, and includes not only liquid state substance having a high or low viscosity, fluid state substance such as inorganic solvent such as sol and gel water, organic solvent, solution, liquid state resin, liquid state metal (melted metal), or liquid as a state of the substance, but also those obtained by dissolving, dispersing, or mixing particles of functional material formed of solid state substance such as pigment or metal particles in a solvent. Representative examples of the liquid include ink as described in the embodiment and liquid crystal. The term "ink" here includes various liquid compositions such as general water-based ink, oil-based ink, gel ink, hot-melt ink. Detailed examples of the liquid ejecting apparatus may include liquid ejecting apparatuses which ejects liquid containing materials such as electrode material or colorant in the form of dispersion or dissolution used for manufacturing, for example, liquid crystal displays, EL (electroluminescence) displays, surface emission-type displays, or color filters, liquid ejecting apparatuses which eject biological organic substance used for manufacturing biochips, liquid ejecting apparatuses which are used as accurate pipettes and eject liquid as a sample, text printing apparatuses, or microdispensers. Furthermore, liquid ejecting apparatuses for ejecting lubricant for pinpoint lubrication for precise machines such as watches or cameras, liquid ejecting apparatuses for ejecting transparent resin liquid such as UV-cured resin on a substrate for forming micro-semispherical lens (optical lens) used for optical communication elements or the like, and liquid ejecting apparatuses for ejecting etching liquid such as acid or alkali for etching the substrate or the like may be employed. The invention may be applied to any one of the liquid ejecting apparatuses.

What is claimed is:

1. A liquid ejecting apparatus configured to eject liquid to a target being transported comprising:

a liquid ejection head configured to eject liquid from a nozzle formed on a nozzle-formed surface to the target;

a plurality of supporting members arranged so as to oppose the nozzle-formed surface and each having a supporting portion extending along the direction of transport of the target; and a moving unit configured to cause the supporting members to move along the direction of width of the target, which intersects the direction of transport, wherein, the moving unit comprises:

a cylindrical cam configured to be rotatable about an axial line extending in the width direction;

a plurality of cam grooves formed on the surface of the cylindrical cam; and an adjusting member configured to pinch one of the plurality of supporting members at one end thereof and inserted at the other end thereof into one of the cam grooves.

* * * * *